US009039459B2

(12) United States Patent
Fukano et al.

(10) Patent No.: US 9,039,459 B2
(45) Date of Patent: May 26, 2015

(54) LAMP SOCKET

(75) Inventors: Satoshi Fukano, Nara (JP); Yoshihide Imaoka, Osaka (JP); Tetsuya Matsumoto, Gunma (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 57 days.

(21) Appl. No.: 13/885,703

(22) PCT Filed: Dec. 9, 2011

(86) PCT No.: PCT/JP2011/078535

§ 371 (c)(1),
(2), (4) Date: May 16, 2013

(87) PCT Pub. No.: WO2012/086434

PCT Pub. Date: Jun. 28, 2012

(65) Prior Publication Data

US 2013/0237101 A1 Sep. 12, 2013

(30) Foreign Application Priority Data

Dec. 21, 2010 (JP) ..... 2010-283954

(51) Int. Cl.
*H01R 33/06* (2006.01)
*H01R 33/08* (2006.01)

(52) U.S. Cl.
CPC ..... *H01R 33/06* (2013.01); *H01R 33/0854* (2013.01)

(58) Field of Classification Search
USPC ..... 439/702, 241, 232, 227, 236; 362/217.05, 260, 217.17
See application file for complete search history.

(56) References Cited

U.S. PATENT DOCUMENTS 2,313,036 A * 3/1943 Burt ..... 200/51.09
3,781,759 A * 12/1973 Shelly, Jr. ..... 439/232
6,159,029 A * 12/2000 Burwell et al. ..... 439/241
7,275,854 B2 * 10/2007 Dorleijn et al. ..... 362/649

(Continued)

FOREIGN PATENT DOCUMENTS

CN 103081256 5/2013
EP 2602884 6/2013

(Continued)

OTHER PUBLICATIONS

International Search Report dated Jan. 24, 2012 with English language translation.

(Continued)

*Primary Examiner* — Alexander Gilman
(74) *Attorney, Agent, or Firm* — Greenblum & Bernstein, P.L.C.

(57) ABSTRACT

A lamp socket receives an LED lamp provided with an L-shaped pin having a contact piece and an extension piece extending from a tip of the contact piece. The lamp socket includes a socket body having an insertion hole at its front surface and a conductive plate. The conductive plate has one surface facing an axis of the insertion hole and a first space is formed between the other surface of the conductive plate and an inner surface of the socket body. A second space is formed between a bottom surface of the socket body and the conductive plate. A third space, or rotation space, is formed between the first space and the bottom surface. When the pin is inserted via the insertion hole and the LED lamp is rotated, the contact piece comes in contact with the conductive plate and the extension piece passes through the rotation space.

7 Claims, 8 Drawing Sheets

(56) References Cited

U.S. PATENT DOCUMENTS

| | | | | |
|---|---|---|---|---|
| 7,325,965 | B2 * | 2/2008 | Lingemann et al. | 362/655 |
| 7,402,061 | B1 * | 7/2008 | Tseng | 439/236 |
| 7,549,787 | B1 * | 6/2009 | Blaymore | 362/655 |
| 8,018,129 | B2 * | 9/2011 | Nakazawa | 313/318.01 |
| 8,040,032 | B2 * | 10/2011 | Kovacs | 313/318.01 |
| 8,282,408 | B1 * | 10/2012 | Chou et al. | 439/226 |
| 2013/0170194 | A1 | 7/2013 | Osada | |

FOREIGN PATENT DOCUMENTS

| | | |
|---|---|---|
| JP | 354790 | 12/1945 |
| JP | 2006-331701 | 12/2006 |
| JP | 2010-044893 | 2/2010 |

OTHER PUBLICATIONS

Search report from E.P.O., mail date is Jun. 2, 2014.

* cited by examiner

LAMP SOCKET

TECHNICAL FIELD

The present invention relates to lamp sockets.

BACKGROUND ART

Recently, there has been proposed a straight tube LED lamp (hereinafter, referred to as "LED lamp") as an alternative to a straight tube fluorescent lamp (hereinafter, referred to as "fluorescent lamp").

There have been proposed various kinds of LED lamps. For example, an LED lamp having the same base as that of a fluorescent lamp has been proposed. Such an LED lamp can be easily used as a replacement of a fluorescent lamp.

However, a procedure necessary for replacing a fluorescent lamp by an LED lamp (e.g., whether or not an additional power circuit is necessary) is not standardized with regard to manufacturers. In brief, manufacturers adopt different procedures for adapting a lighting fixture available for a fluorescent lamp to an LED lamp.

Meanwhile, to prevent improper connection of an LED lamp to a lamp socket (see patent document 1) available for a fluorescent lamp, as shown in FIG. 11, an LED lamp 300 with an L-shaped pin 310 which is different in shape from a straight pin of the fluorescent lamp is standardized.

The L-shaped pin 310 is formed so as to stand on an edge surface of a base 330 provided to an end of a light tube 320. The L-shaped pin 310 is constituted by a contact piece 311 extending from the edge surface along an axial direction of the light tube 320 and an extension piece 312 extending from a tip of the contact piece 311 along a radial direction of the light tube 320. In this instance, the two pins 310 are arranged side-by-side on the edge surface of the base 330. The two pins 310 are arranged such that the extension pieces 312 of the two pins 310 are directed to opposite directions.

Accordingly, a lamp socket available for the LED lamp 300 with the L-shaped pin 310 is necessary.

CITATION LIST

Patent Literature

Patent Document 1 JP 2006-331701 A

SUMMARY OF INVENTION

Technical Problem

As a lamp socket available for the fluorescent lamp, a lamp socket (fluorescent lamp socket) employing a rotation mechanism which allows the fluorescent lamp to be attached to the lamp socket by inserting the pin of the fluorescent lamp to the lamp socket and then rotating the fluorescent lamp about its axis has been proposed. Further, as for the LED lamp 300 with the L-shaped pin 310, an LED lamp socket which allows a lamp to be connected to the lamp socket through rotation of the lamp in a similar manner as the fluorescent lamp has been desired.

However, when the LED lamp socket with a rotational mechanism is fabricated by use of parts used in the fluorescent lamp socket, the extension piece 312 interferes with components of the lamp socket upon being rotated. Hence, the LED lamp 300 is not allowed to be attached to such a lamp socket.

In view of the above insufficiency, the present invention has aimed to propose a lamp socket which enables attachment of a straight tube LED lamp having an L-shaped pin to the lamp socket by means of rotating the LED lamp and can be fabricated at a lowered cost.

Solution to Problem

In order to solve the above problem, the lamp socket in accordance with the present invention is a lamp socket for receiving a lamp including a light tube shaped into a straight tube and a base provided to an end of the light tube. The base is provided with a pin including a contact piece extending along an axial direction of the light tube and an extension piece extending along a radial direction of the light tube from a tip of the contact piece, at its end surface in the axial direction. The lamp socket includes: a socket body formed into a hollow box shape and provided with an insertion hole at its primary surface; and a conductive plate for power supply. The conductive plate is formed into an approximate band plate shape. The conductive plate is positioned inside the socket body so as to have a width direction along the axial direction and face the insertion hole. The conductive plate has one surface opposite to a central axis of the insertion hole. A first space is provided between the other surface of the conductive plate and an inner periphery of the socket body. A second space is provided between a bottom surface of the socket body opposite to the primary surface of the socket body and the conductive plate. A third space is provided between the first space and the bottom surface of the socket body and communicates with the second space so as to form a rotation space together with the second space. When the pin of the lamp is inserted into the insertion hole and the lamp is rotated about its axis, the contact piece comes in contact with the one surface of the conductive plate and a rotation track of the extension piece passes through the rotation space.

In another preferred aspect of the lamp socket, the socket body is provided at its inner surface with a first pedestal, a second pedestal, and a limitation part. The first pedestal has a first mounting surface on which a part of the conductive plate is mounted. The second pedestal is formed at a position far from the first pedestal and having a second mounting surface on which another part of the conductive plate is mounted. The limitation part includes a first limitation piece facing the one surface of the conductive plate and a second limitation piece facing the other surface of the conductive plate. The conductive plate is fixed on the second mounting surface.

In another preferred aspect of the lamp socket, the conductive plate is mounted on the bottom surface of the socket body. The conductive plate is formed with a cutout at a side close to the bottom surface of the socket body of one end in a lengthwise direction of the conductive plate so as to form the second space.

In another preferred aspect of the lamp socket, the socket body is provided at its inner surface with a first pedestal, and a limitation part. The first pedestal has a first mounting surface on which the one end in the lengthwise direction of the conductive plate is mounted. The limitation part is arranged on the first mounting surface and includes a first limitation piece facing the one surface of the conductive plate and a second limitation piece facing the other surface of the conductive plate. The conductive plate is fixed on the bottom surface of the socket body at the other end in the lengthwise direction.

In another preferred aspect of the lamp socket, the conductive plate includes a conductive plate body part and a protrusion piece. The conductive plate body part is formed into a band plate shape and has the width direction along the axial direction. The protrusion piece extends perpendicularly from the conductive plate body part, and the protrusion piece is placed on the first mounting surface so as to be in face-to-face contact with the first mounting surface.

In another preferred aspect of the lamp socket, the socket body is constituted by a first member provided with the first pedestal and a second member provided with the insertion hole. One limitation piece of the first limitation piece and the second limitation piece is formed on the first mounting surface of the first pedestal. The other limitation piece of the first limitation piece and the second limitation piece is formed on a surface of the second member facing the first mounting surface. The other limitation piece has an inclined surface which is inclined to be farther away from the one limitation piece as being closer to the first mounting surface.

Advantageous Effects of Invention

According to the present invention, it is possible to propose a lamp socket which enables attachment of a straight tube LED lamp having an L-shaped pin to the lamp socket by means of rotating the LED lamp and can be fabricated at a lowered cost.

DESCRIPTION OF EMBODIMENTS

The following explanations referring to drawings are made to embodiments of the present invention.

First Embodiment

Figure 12:
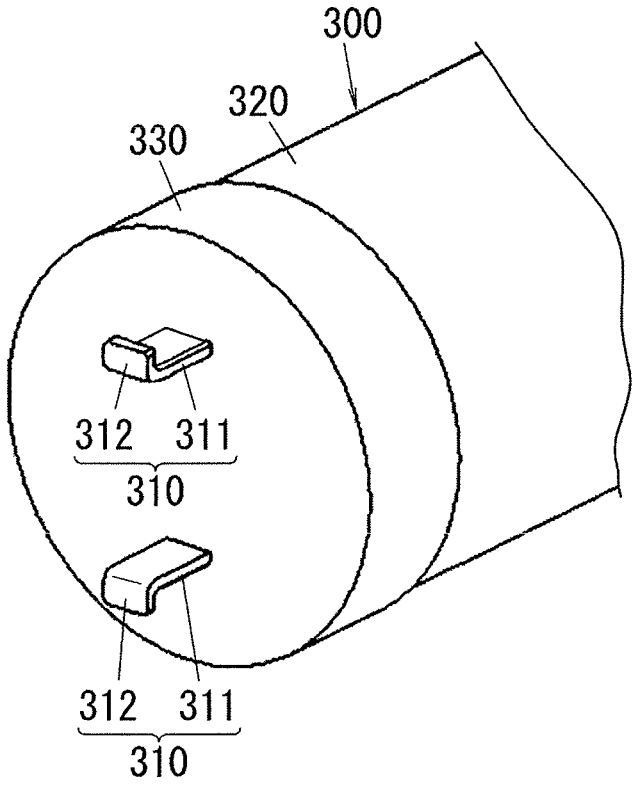
FIG. 12 is a schematic perspective view illustrating the straight tube LED lamp having L-shaped pins.

The lamp socket "A" of the present embodiment is used for attaching a straight tube LED lamp 300 including L-shaped pins 310 as shown in FIG. 12 in the background art to a lighting fixture (not shown).

Note that, the L-shaped pin 310 includes a contact piece 311 and an extension piece 312. The contact piece 311 is formed extending along an axial direction of a light tube 320. The extension piece 312 extends along a radial direction of the light tube 320 from a tip of the contact piece 311. In this regard, the pin 310 is defined as the L-shaped or approximate L-shaped pin 310.

Figure 1:
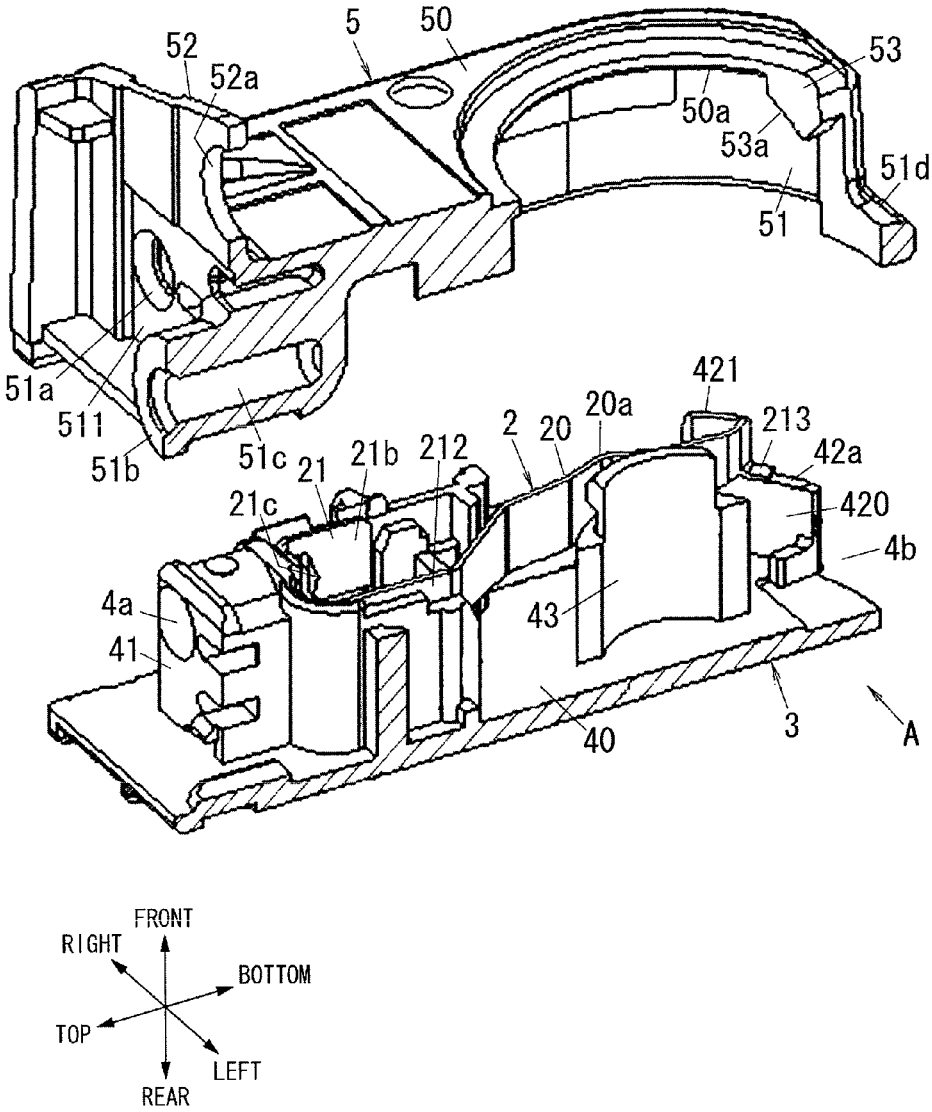
FIG. 1 is a schematic sectional view illustrating the lamp socket in accordance with the first embodiment.
Figure 2:
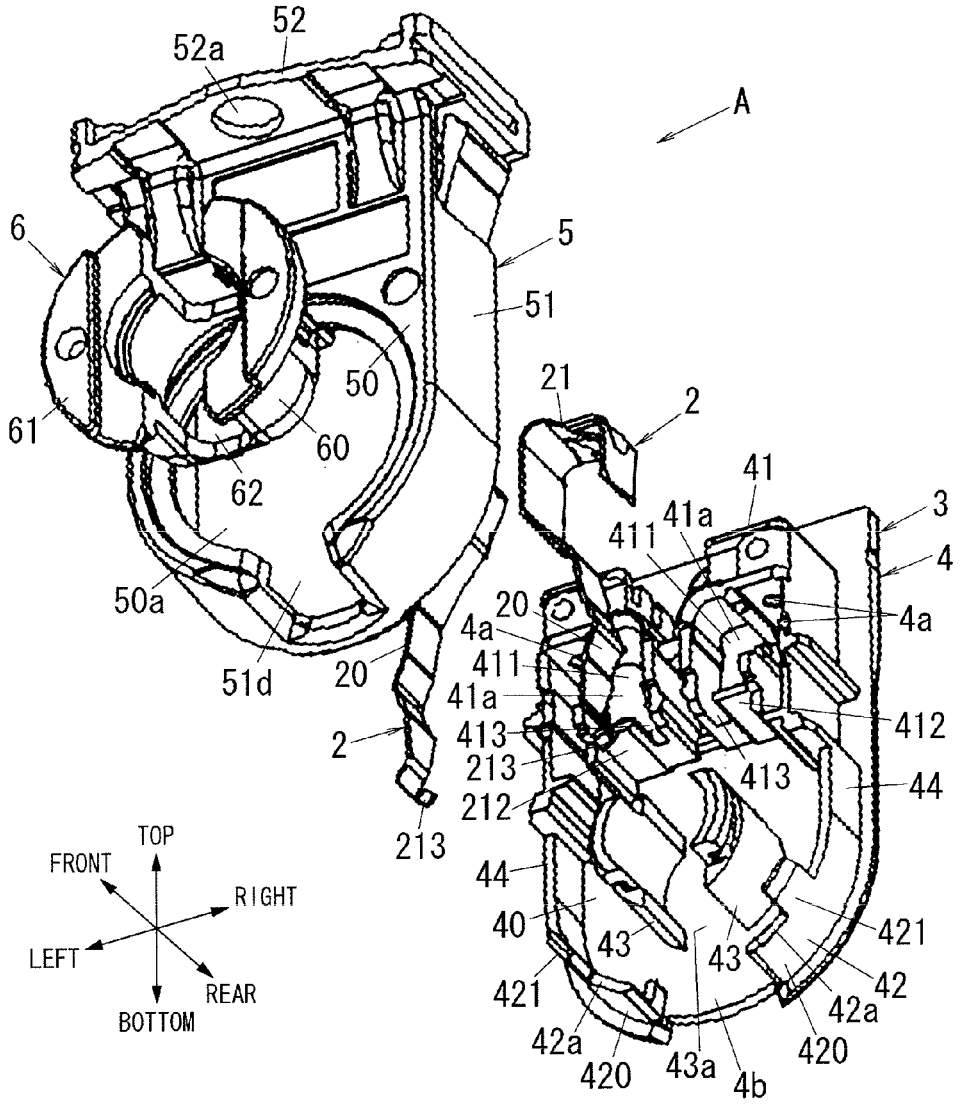
FIG. 2 is an exploded perspective view illustrating the lamp socket in accordance with the above embodiment.

The lamp socket "A" is attached to the aforementioned lighting fixture, and includes, as shown in FIGS. 1 and 2, paired conductive plates 2 respectively connected to the paired pins 310 in contact manner, and a socket body 3 configured to accommodate the paired conductive plates 2. In the following, the present embodiment is explained based on upward, downward, left, and right directions in FIG. 2 and forward and rearward directions defined by directions normal to each of the upward, downward, left, and right directions.

Figure 3:
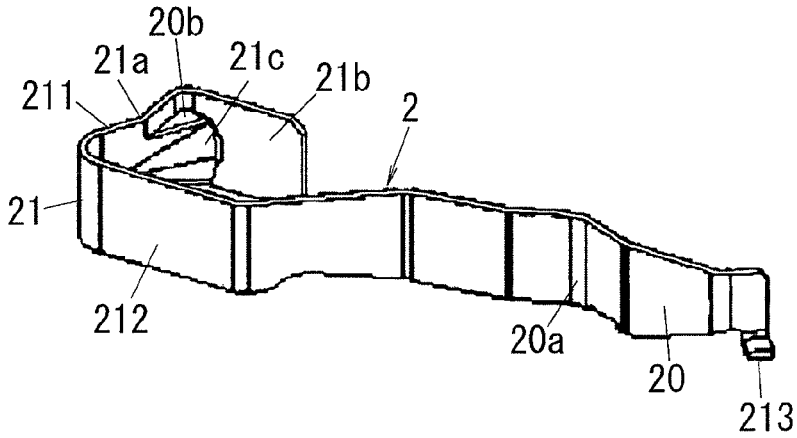
FIG. 3 is a perspective view illustrating the conductive plate of the lamp socket in accordance with the above embodiment.

As shown in FIG. 3, the conductive plate 2 is formed by means of bending a plate material formed into a band plate shape made of resilient metal material. The conductive plate 2 includes a pin connection part 20 and a fixed part 21. The pin connection part 20 is formed into an approximate circular arc shape along a lengthwise direction. The fixed part 21 is integrally formed with an end in a lengthwise direction of the pin connection part 20.

The pin connection part 20 has a recessed surface side serving as a contact surface for receiving the pin 310. The pin connection part 20 is provided at its center part with a recessed part 20*a* which is formed into an approximate triangle shape and is protruded from the recessed surface side to a protruded surface side. The recessed part 20*a* is used for positioning the pin 310 in a predetermined position relative to the conductive plate 2 by means of engaging the pin 310 with the recessed part 20*a*. Further, a tip of the pin connection part 20 is bent toward the protruded surface side. A protrusion piece 213 is formed into an approximate rectangular plate shape and extends perpendicularly from a rear side of the recessed surface side of the tip of the pin connection part 20.

Note that, the recessed surface side of the pin connection part 20 is defined as one surface (first surface) of the conductive plate 2 and the protruded surface side of the pin connection part 20 is defined as the other surface (second surface) of the conductive plate 2.

The fixed part 21 includes a terminal part 211 and a coupling part 212. The terminal part 211 is configured to receive a power supply cable (not shown). The coupling part 212 integrally connects between the terminal part 211 and the pin connection part 20.

The terminal part 211 includes a lateral piece 21*a*, a longitudinal piece 21*b*, and a locking piece 21*c*. The lateral piece 21*a* is formed into a rectangular plate shape and is provided with an insertion opening 20*b* designed to allow a power supply cable to pass. The longitudinal piece 21*b* extends perpendicularly from a first end in a left and right direction of the lateral piece 21*a*. The locking piece 21*c* extends from a second end in the left and right direction of the lateral piece 21*a* and comes closer to the longitudinal piece 21*b* with increasing distance to the lateral piece 21*a* in a perpendicularly extending direction of the longitudinal piece 21*b*. The locking piece 21*c* holds a power supply cable (not shown) inserted via the insertion opening 20*b* together with the longitudinal piece 21*b* such that the power supply cable is held between the locking piece 21*c* and the longitudinal piece 21*b*. At this time, the locking piece 21*c* bites into the power supply cable, thereby preventing undesired disconnection of the power supply cable from the insertion opening 20*b*. In other words, the terminal part 211 holds a power supply cable inserted via the insertion opening 20*b* between a tip of the locking piece 21*c* and the longitudinal piece 21*b*. Thus, the terminal part 211 serves as a so-called quick connection terminal performing mechanical connection and electrical connection of the power supply cable simultaneously.

Figure 4:
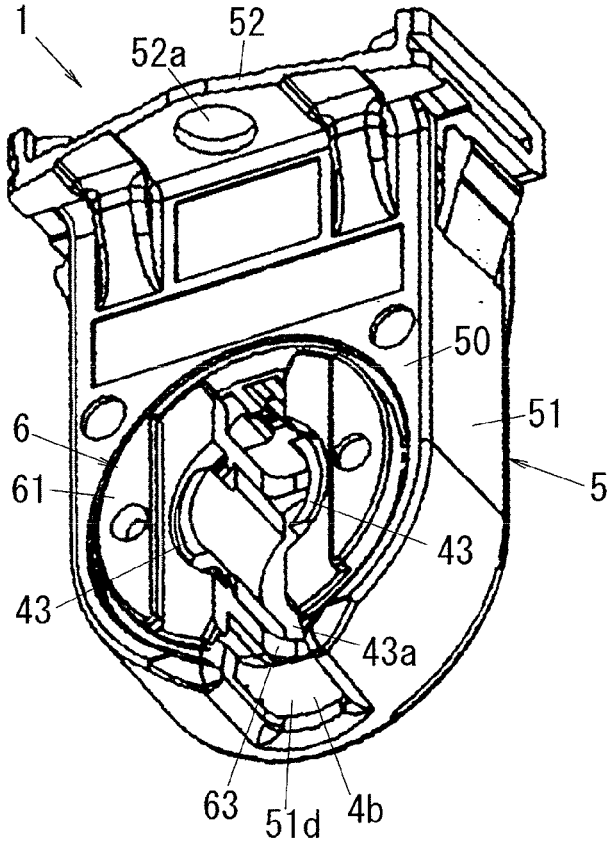
FIG. 4 is a perspective view illustrating the lamp socket in accordance with the above embodiment.

As shown in FIGS. 2 and 4, the socket body 3 includes a body 4, a cover 5, and a rotator 6. The body 4 is formed into a box shape having a front surface opened. The body 4 houses the paired conductive plates 2. The cover 5 is attached to the body 4 so as to cover the front surface of the body 4. The rotator 6 is rotatively attached to the body 4 and the cover 5. The body 4, the cover 5, and the rotator 6 are molded parts made of dielectric resin material, for example. Note that, the cover 5 and the rotator 6 may be the same parts as those used in a lamp socket of a prior straight fluorescent lamp.

Accordingly, the socket body 3 is formed into a hollow box shape. Further, the conductive plate 2 for power supply is placed in a position facing an insertion hole 51*a*.

The body 4 is provided at respective opposite ends in the left and right direction of an upper side wall (upper wall) with cable insertion openings 4*a*. Additionally, a release hole (not shown) is formed penetrating through a vicinity of the cable insertion opening 4*a*.

As for the body 4, pedestals (second pedestals) 411 are protruded from a bottom surface of the body 4 below the upper wall 41 so as to be arranged side-by-side in the left and right direction. Each pedestal 411 is formed into an approximate cuboid shape. Further, wall parts 412 are protruded forward below the paired pedestals 411, respectively. As for each wall part 412, a rectangular cutout 413 extending from a front end to a rear end of a wall part 412 is formed.

Additionally, an opening part 4*b* for inserting the pin 310 into the body 4 is formed in the center of a lower side wall (lower wall) 42 of the body 4. Further, formed on left and right vicinities of the opening part 4*b* of the lower wall 42 are pedestals (first pedestals) 420 from which first limitation pieces 421 formed into an approximate rectangular plate shape are protruded forward respectively.

Hence, the second pedestal 411 is formed at a position far from the first pedestal 420.

Further, paired shaft parts 43 constituting a shaft to which the rotator 6 is rotatively attached are formed on the bottom surface 40. The shaft part 43 is positioned between the pedestal 411 and the side wall 42. The shaft part 43 is formed into a circular arc shape. The shaft parts 43 are arranged side-by-side in the left and right direction such that recessed surfaces of the respective shaft parts 43 are opposite to each other. A space between the paired shaft parts 43 defines a clearance 43*a* allowing the pin 310 to pass in the upward and downward direction. Thus, one of the paired pins 310 of the lamp 300 can be positioned between the pedestal 411 and the shaft parts 43 while the other can be positioned between the opening part 4*b* and the shaft part 55.

The conductive plate 2 is attached to the body 4 as follows. The conductive plate 2 is placed on the front surface (second mounting surface) 41*a* of the pedestal 411 such that the insertion opening 20*b* of the fixed part 21 communicates with the cable insertion opening 4*a* of the body 4. Further, the pin connection part 20 is placed such that the recessed surface of the pin connection part 20 faces the shaft parts 43 and the protrusion piece 213 provided at the tip (lower end, in FIG. 2) of the pin connection part 20 is mounted on the end surface (first mounting surface) 42*a* of the pedestal 420 between the opening part 4*b* and the first limitation piece 421. In this regard, the protrusion piece 213 is in face-to-face contact with the second mounting surface 42*a*. Hence, the conductive plate 2 is supported stably. Moreover, the coupling part 212 is inserted into the cutout 413. The fixed part 21 is fixed on the first mounting surface 41*a*. The pin connection part 20 can be elastically deformed with regard to the left and right direction around a fulcrum defined by a connection point of the pin connection part 20 and the coupling part 212.

Namely, the conductive plate 2 is mounted on the first mounting surface 42*a* of the first pedestal 420. Further, the conductive plate 2 is mounted also on the second mounting surface 41*a* of the second pedestal 411. Additionally, with mounting the fixed part 21 on the second mounting surface 41*a*, the conductive plate 2 is fixed on the second mounting surface 41*a*.

Figure 5:
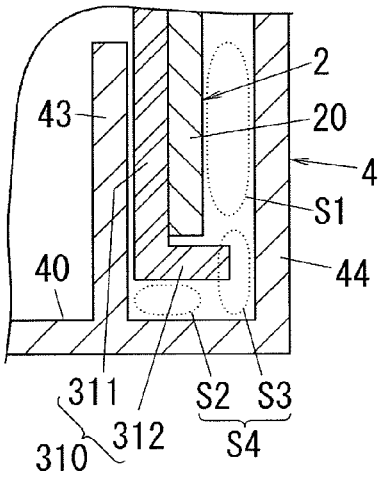
FIG. 5 is a sectional view illustrating a primary part of the lamp socket in accordance with the above embodiment.

Besides, as shown in FIG. 5, spaces (first spaces) S1 are formed between protruded surfaces of the pin connection parts 20 and left and right surfaces 44 of the body 4, respectively. Further, since the conductive plate 2 is placed on the first and second mounting surfaces 42*a* and 41*a*, a space (second space) S2 is formed between the conductive plate 2 and the bottom surface 40 of the body 4. The second space communicates with the space S1 via a space (third space) S3 formed between the space S1 and the bottom surface 40 of the body 4.

Consequently, the first space S1 is provided between the other surface of the conductive plate 2 (the protruded surface of the pin connection part 20, the second surface of the conductive plate 2) and an inner periphery of the socket body 3 (the left and right side surfaces 44 of the body 4). The bottom surface of the body 4 faces the primary surface (flat plate part 50) of the socket body 3 is defined as the bottom surface of the socket body 3. The second space S2 is provided between the bottom surface of the socket body 3 and the conductive plate 2. Further, the third space S3 designed to communicate with the second space S2 so as to form a rotation space together with the second space S2 is provided between the first space S1 and the bottom surface of the socket body 3.

The cover 5 includes the flat plate part 50 and a peripheral wall part 51. The flat plate part 50 is shaped so as to cover the front surface of the body 4. The peripheral wall part 51 extends rearward from a periphery of the flat plate part 50 and is shaped so as to surround a peripheral wall part of the body 4. The insertion hole 50*a* is formed in the flat plate part 50. The insertion hole 50*a* is concentric with the shaft parts 43 of the body 4. The insertion hole 50*a* has an inner diameter greater than an outer width between the paired pins 310. The rotator 6 is rotatively disposed inside the insertion hole 50*a*.

In brief, the socket body 3 formed into a hollow box shape is provided with the insertion hole 51*a* at its primary surface.

A second limitation piece 53 is protruded from a part of a rear surface of the flat plate part 50 opposite to the first mounting surface 42*a*. The second limitation piece 53 has an inclined surface 53*a*. The inclined surface 53*a* is inclined to be farther away from the first limitation piece 421 as being closer to the first mounting surface 42*a*. When the cover 5 is placed so as to cover the front surface of the body 4, the protrusion piece 213 of the conductive plate 2 is positioned between the first limitation piece 421 and the second limitation piece 53. Thus, a movable range of the tip of the pin connection part 20 is limited to a range between the first limitation piece 421 and the second limitation piece 53. In other words, the movable range of the pin connection part 20 is defined by a limitation part constituted by the first and second limitation pieces 421 and 53.

In this manner, the protrusion piece 213 of the conductive plate 2 is positioned between the first limitation piece 421 and the second limitation piece 53. Therefore, the one surface (first surface) of the conductive plate 2 faces the first limitation piece 421. Further, the other surface (second surface) of the conductive plate 2 faces the second limitation piece 53.

Further, the second limitation piece 53 includes the inclined surface 53*a*. Hence, for example, in a process of attaching the cover 5 to the body 4 so as to cover the body 4, even when the second limitation piece 53 comes in contact with the pin connection part 20, the pin connection part 20 is allowed to slide on the inclined surface 53*a*. Thus, it is possible to facilitate the process of the attaching the cover 5.

Furthermore, as shown in FIG. 1, formed in a part of the peripheral wall part 51 of the cover 5 opposite to the cable insertion opening 4*a* of the body 4 is a cable insertion hole 51*a* such that the cable insertion hole 51*a* communicates with the cable insertion opening 4*a*. Besides, protruded from a center of an upper wall part (upper wall) 511 of the peripheral wall part 51 is a boss part 51*b* formed into a circular hollow cylindrical shape. Formed inside the boss part 51*b* is a screw hole 51*c* used for attaching the lamp socket "A" to a lighting fixture. A pin insertion hole 51*d* is formed in a part of the peripheral wall part 51 opposite to the opening part 4*b* of the body 4 so as to communicate with the opening part 4*b*.

As shown in FIG. 4, an attachment base 52 is protruded forward from the upper end side of the cover 5. The attachment base 52 is formed into a flat plate shape. Formed in an approximate center of the attachment base 52 is a screw insertion hole 52*a* used for attaching the lamp socket "A" to a lighting fixture.

Like the body 4 and the cover 5, the rotator 6 is a molded part made of dielectric resin material, for example. The rotator 6 includes a bearing part 60 and a closure part 61. The bearing part 60 is formed into an approximate circular cylindrical shape and is designed to allow the shaft parts 55 of the body 4 to be inserted into the bearing part 60. The closure part 61 is formed at a front end of the bearing part 60 so as to close the insertion hole 50*a* of the cover 5.

Further, the rotator 6 is provided with a cutout part 62 formed to pass through a rotational axis of the bearing part 60 and extend along a radial direction of the closure part 61. As shown in FIG. 4, in a state (opened state) in which the cutout part 62 of the rotator 6 is aligned with (opposite to) the clearance 43*a* between the shaft parts 43, the pin 310 is allowed to be inserted into the socket body 3 via the opening part 4*b*. Meanwhile, in a state (closed state) in which the cutout part 62 is not aligned with (opposite to) the clearance 43*a* when the cutout part 62 is rotated around its axis, the pin 310 is not allowed to be inserted into the socket body 3 via the opening part 4*b*.

The following explanation is made to a procedure of attaching the straight tube LED lamp 300 to the lamp socket "A" of the present embodiment constructed as mentioned above.

First, the rotator 6 is set to the opened state, and the LED lamp 300 is moved upward from underneath the lamp socket "A" while the LED lamp 300 has the axial direction along the forward and rearward direction. Thereafter, the pin 310 is inserted into the socket body 3 via the opening part 4*b*. Further, the LED lamp 300 is moved to a position (opened position) in which one of the paired pins 310 is interposed between the pedestal 411 and the shaft parts 43 and the other is interposed between the opening part 4*b* and the shaft parts 43. Subsequently, the LED lamp 300 is rotated along one direction around its axis at about 90 degrees, and then the contact piece 311 of the pin 310 is moved into a space between the pin connection part 20 and the shaft parts 43. Consequently, the contact piece 311 slides on the recessed surface of the pin connection part 20 to a position (closed position) in which the contact piece 311 faces the recessed part 20*a* while the contact piece 311 is in contact with the pin connection part 20 and displaces the pin connection part 20 in the left and right direction. Finally, the contact piece 311 is fitted into the recessed part 20*c*. As a result, connection between the pin 310 and the conductive plate 2 is made and power supply to the LED lamp 300 is enabled. Note that, to detach the LED lamp 300 from the lamp socket "A", it is sufficient that the procedure of attaching the lamp is carried out in the reverse order.

In the above procedure, when the contact piece 311 is rotated within the space between the pin connection part 20 and the shaft parts 43, the extension piece 312 is rotated inside the rotation space S4 constituted by the space S2 and the space S3 as shown in FIG. 5. In brief, since a rotation track of the extension piece 312 passes through the rotation space S4, it is possible to rotate the lamp 300 from the opened position to the closed position without interference of the extension piece 312 with the conductive plate 2.

As described in above, the LED lamp 300 with the L-shaped pins 300 can be attached to the lamp socket "A" of the present embodiment including the cover 5 and the rotator 6 which are used in a prior lamp socket for receiving a straight tube fluorescent lamp. Hence, in view of the production process, since the cover 5 and the rotator 6 can be used in common for the lamp socket "A" and the lamp socket for the straight tube fluorescent lamp, it is possible to reduce a mold cost of the socket body 3. Consequently, the lamp socket "A" can be produced at the lowered production cost.

Note that, in the present embodiment, the first limitation piece 421 is protruded from the pedestal 420, and the second limitation piece 53 is protruded from the cover 5. However, the positions of the first and second limitation pieces 421 and 53 are not limited to the present instances, but may be protruded from other positions such as the peripheral wall part 51 of the cover 5.

As mentioned in above, the lamp socket "A" of the present embodiment is configured to hold the lamp 300.

The lamp 300 includes the light tube 320 shaped into a straight tube and a base 330 provided to an end of the light tube 320. The base 330 is provided with the pin 310. The pin 310 includes the contact piece 311 and the extension piece 312. The contact piece 311 extends along the axial direction of the light tube 320. The extension piece 312 extends along the radial direction of the light tube 320 from the tip of the contact piece 311. Thus, the pin 310 is formed into an approximate L-shape. The pin 310 is provided to an end surface of the base 330 in the axial direction of the light tube 320.

The lamp socket "A" includes the socket body 3 and the conductive plate 2. The socket body 3 is formed into a hollow box shape. The socket body 3 is provided with the insertion hole 51*a* at its primary surface. The conductive plate 2 is formed into an approximate band plate shape. The conductive plate 2 is positioned such that the width direction of the conductive plate 2 is parallel to a direction extending along the axial direction of the light tube 320. The conductive plate 2 is placed inside the socket body 3 so as to face the insertion hole 51*a*. In other words, the conductive plate 2 is disposed inside the socket body 3 and is exposed to the outside of the socket body 3 through the insertion hole 51*a*. The conductive plate 2 is provided for power supply to the light tube 320.

The conductive plate 2 has the one surface and the other surface. The one surface of the conductive plate 2 is defined as the first surface, and the other surface of the conductive plate 2 is defined as the second surface. The conductive plate 2 has the one surface (first surface) opposite to a central axis of the insertion hole 51*a*. The conductive plate 2 is positioned such that the first space S1 is provided between the other surface (second surface) of the conductive plate 2 and the inner periphery of the socket body 3. The socket body 3 has the bottom surface opposite to the primary surface of the socket body 3. The conductive plate 2 is positioned such that the second space S2 is formed between the bottom surface of the socket body 3 and the conductive plate 2. Further, the conductive plate 2 is positioned so as to form the third space S3. The third space S3 connects the first space S1 to the second space S2. Thus, the third space S3 constitutes the rotation space together with the second space S2.

When the pin 310 of the lamp 300 is inserted into the insertion hole 51*a* and the lamp 300 is rotated about its axis, the contact piece 311 comes in contact with the one surface of the conductive plate 2. Further, a track of the extension piece 312 obtained when the pin 310 of the lamp 300 is inserted into the insertion hole 51*a* and the lamp 300 is rotated about its axis, is defined as the rotation track of the extension piece 312. The rotation track of the extension piece 312 passes through the rotation space.

According to this embodiment, it is possible to propose the lamp socket "A" which enables attachment of the straight tube LED lamp 300 having the pin 310 including the contact piece 311 and the extension piece 312 to the lamp socket "A" by means of rotating the LED lamp 300 and can be fabricated at a lowered cost.

Further, the socket body 3 is provided at its inner surface with the first pedestal 420, the second pedestal 411, and the limitation part. The first pedestal 420 has the first mounting surface 42*a* on which the conductive plate 2 is mounted. The second pedestal 411 is formed at a position far from the first pedestal 420. The second pedestal 411 has the second mounting surface 41*a* on which the conductive plate 2 is mounted. The limitation part includes the first limitation piece 421 and the second limitation piece 53. The first limitation piece 421 is formed so as to face the one surface (first surface) of the conductive plate 2. The second limitation piece 53 is formed so as to face the other surface (second surface) of the conductive plate 2. The first limitation piece 421 is positioned on the first pedestal 420. The conductive plate 2 is fixed on the second mounting surface 41*a*.

Furthermore, the conductive plate 2 includes a conductive plate body part and the protrusion piece 213. The conductive plate 2 is formed into a band plate shape and has the width direction along the axial direction of the light tube 320. The protrusion piece 213 extends perpendicularly from the conductive plate body part. The protrusion piece 213 is placed on the first mounting surface 42*a*, thereby being in face-to-face contact with the first mounting surface 42*a*.

Besides, the first mounting surface 42*a* has length along a circumferential direction of the light tube 320. Thus, the first mounting surface 42*a* has a lengthwise direction extending along the circumferential direction of the light tube 320. The protrusion piece 213 extends from the conductive plate body part along the lengthwise direction of the first mounting surface 42*a*.

Moreover, the socket body 3 is constituted by a first member and a second member. The first member is provided with the first pedestal 420. The second member is provided with the insertion hole 51*a*.

One limitation piece of the first limitation piece 421 and the second limitation piece 53 is formed on the first mounting surface 42*a* of the first pedestal 420. When the first limitation piece 421 is provided on the first mounting surface 42*a*, the first limitation piece 421 is defined as the one limitation piece. When the second limitation piece 53 is provided on the first mounting surface 42*a*, the second limitation piece 53 is defined as the one limitation piece.

The other limitation piece of the first limitation piece 421 and the second limitation piece 53 is formed on a predetermined surface of the second member facing the first mounting surface 42*a*. When the first limitation piece 421 is provided on the surface facing the first mounting surface 42*a*, the first limitation piece 421 is defined as the other limitation piece. When the second limitation piece 53 is provided on the surface facing the first mounting surface 42*a*, the second limitation piece 53 is defined as the other limitation piece.

When the first limitation piece 421 is provided on the first mounting surface 42*a*, the second limitation piece 53 is provided to the predetermined surface of the second member. When the second limitation piece 53 is provided on the first mounting surface 42*a*, the first limitation piece 421 is provided to the predetermined surface of the second member.

The other limitation piece has the inclined surface 53*a* which is inclined to be directed away from the first limitation piece 421 with decreasing distance to the first mounting surface 42*a*.

Further, the socket body 3 includes the shaft part 43. The shaft part 43 is formed to extend along the axial direction of the light tube 320. The conductive plate 2 is positioned such that the one surface thereof faces the outer periphery of the shaft part 43. Hence, the conductive plate 2 has its one surface opposite to the central axis of the insertion hole 51*a*.

Furthermore, the conductive plate 2 is provided with the recessed part 20*a*. A state in which the pin 310 is held between the recessed part 20*a* and the outer periphery of the shaft part 43 is defined as a state in which the conductive plate 2 and the pin 310 are connected to each other. The conductive plate 2 has the tip. The tip of the conductive plate 2 is placed on the first mounting surface 42*a*. The conductive plate 2 has width along the axial direction of the light tube 320. Thus, the tip of the conductive plate 2 has width. Additionally, the recessed part 20*a* has length along the axial direction of the light tube 320. The length of the recessed part 20*a* is greater than the width of the tip of the conductive plate 2.

Besides, the socket body 3 is constituted by the first member provided with the first pedestal 420 and the second member provided with the insertion hole 51*a*. The first member has the bottom surface 40. The first pedestal 420 is disposed on the bottom surface 40. As for the second member, the second limitation piece 53 is formed on the surface facing the first mounting surface 42*a*. The second limitation piece 53 has width across the axial direction of the light tube 320. The second limitation piece 53 is formed such that the width thereof is decreased with decreasing distance to the bottom surface 40 of the first member. The second limitation piece 53 has a first surface and a second surface. The first surface of the second limitation piece 53 faces the conductive plate 2. The second surface of the second limitation piece 53 is an opposite surface of the second limitation piece 53 from the first surface of the second limitation piece 53. The first surface of the second limitation piece 53 is defined as the inclined surface 53*a* which is closer to the second surface of the second limitation piece 53 with decreasing distance to the bottom surface 40.

Moreover, the socket body is constituted by the first member provided with the first pedestal and the second member provided with the insertion hole. The first member has the bottom surface. The first pedestal is disposed on the bottom surface. As for the second member, the second limitation piece is formed on the surface facing the first mounting surface. The second limitation piece has its width across the axial direction of the light tube. The second limitation piece is formed such that the width thereof is decreased with decreasing distance to the bottom surface of the first member. The second limitation piece has the first surface and the second surface. The first surface of the second limitation piece 53 faces the conductive plate. The second surface of the second limitation piece 53 is positioned on an opposite side of the second limitation piece 53 from the first surface of the second limitation piece 53. The second surface of the second limitation piece 53 is defined as an inclined surface which is closer to the first surface of the second limitation piece 53 with decreasing distance to the bottom surface of the first member.

Second Embodiment

The lamp socket "B" of the present embodiment is different from the lamp socket "A" of the first embodiment in the width of the fixed part 21 of the conductive plate 2 and in that the body 4 is not provided with the pedestal 411. Note that, configurations common to the lamp socket of the present embodiment and the lamp socket "A" are designated by the same reference numerals and explanations thereof are deemed unnecessary.

Figure 6:
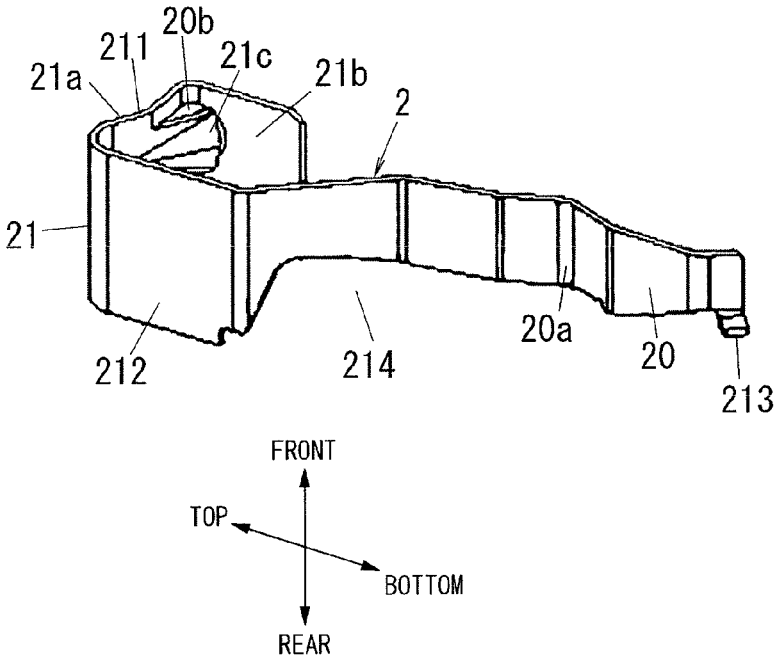
FIG. 6 is a perspective view illustrating the conductive plate of the lamp socket in accordance with the second embodiment.

As shown in FIG. 6, the conductive plate 2 of the present embodiment is provided with a cutout 214 at a rear end of one end (lower end, in FIG. 6) thereof. Consequently, the fixed part 21 is designed to have width which becomes greater toward its rear end than at its front end, relative to the pin connection part 20. The cutout 214 is formed over the length of the pin connection part 20.

In brief, the conductive plate 2 is formed with the cutout at the side close to the bottom surface of the socket body 3 of the one end (first end) in the lengthwise direction thereof.

Figure 7:
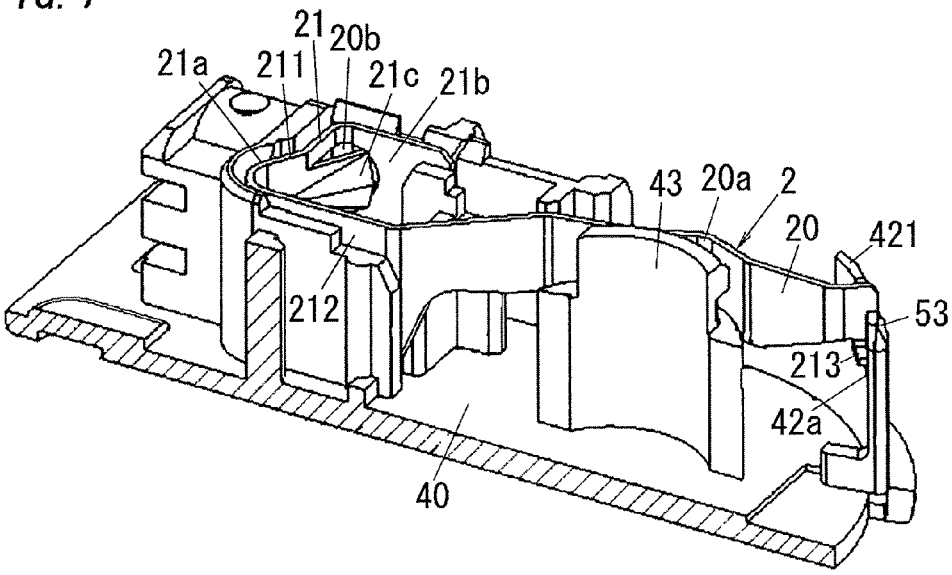
FIG. 7 is a schematic sectional view illustrating the lamp socket in accordance with the above embodiment.

Further, the body 4 is not provided with the pedestal 411 explained in the first embodiment. As shown in FIG. 7, the fixed part 20 of the conductive plate 2 is mounted on the bottom surface 40 of the body 4. Note that, like the lamp socket "A", the pin connection part 21 is mounted on the first mounting surface 42*a*, and the movable range thereof is limited by the first and second limitation pieces 421 and 53. Besides, in the present embodiment, the second limitation piece 53 is protruded from the first mounting surface 42*a*.

Therefore, the fixed part 21 of the conductive plate 2 is mounted on the bottom surface of the body 4. Thus, the conductive plate 2 is mounted on the bottom surface of the socket body 3.

In a situation where the conductive plate 2 is attached to the body 4, the cutout 214 forms the space S2 between the pin connection part 20 and the bottom surface 40 of the body 4.

The procedure of attaching the LED lamp 300 to the lamp socket "B" of the present embodiment is same as that for the lamp socket "A" of the first embodiment, and no explanation thereof is deemed necessary.

In the lamp socket "B" of the present embodiment, the pedestal 411 is mounted on the bottom surface 40 of the socket body 3. Differently from the lamp socket "A" of the first embodiment, there is no need to form the pedestal 411 to the body 4. Hence, according to the present embodiment, it is possible to simplify the structure of the body 4.

Figure 8:
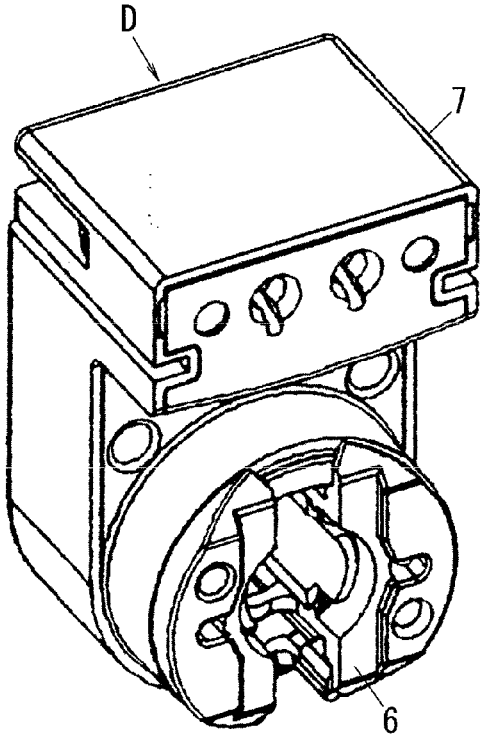
FIG. 8 is a perspective view illustrating the lamp socket including the different socket body in accordance with the above embodiment.
Figure 9:
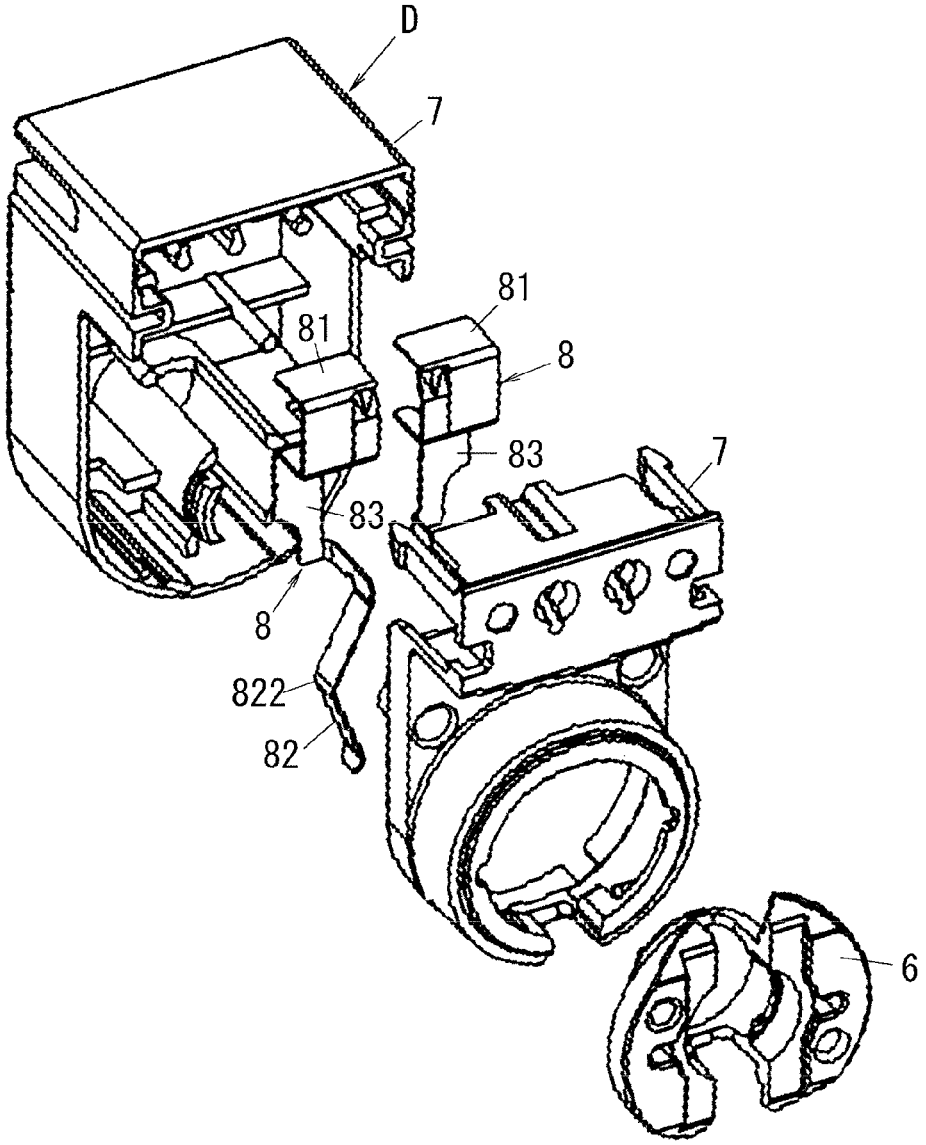
FIG. 9 is an exploded perspective view illustrating the lamp socket in accordance with above embodiment.
Figure 10:
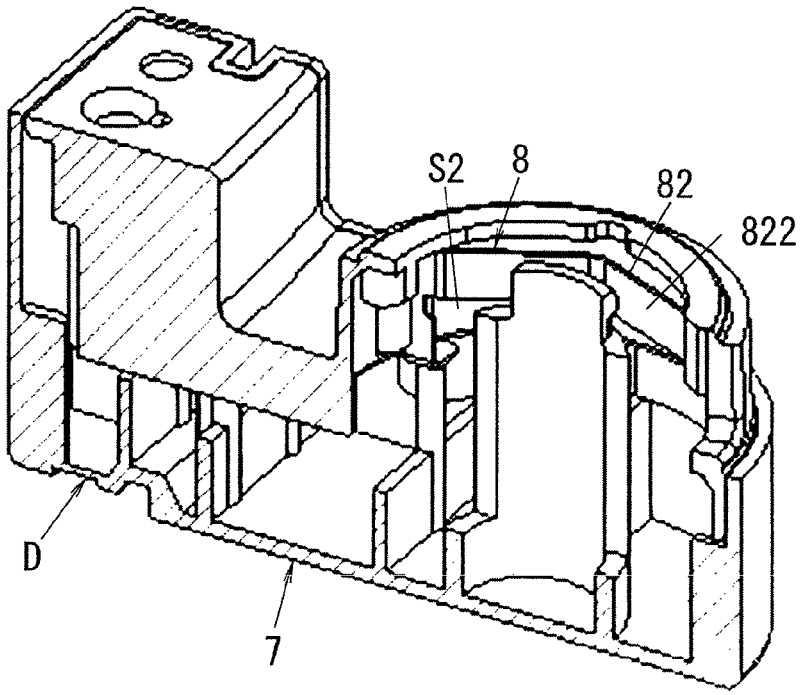
FIG. 10 is a sectional view illustrating the lamp socket in accordance with the above embodiment.
Figure 11:
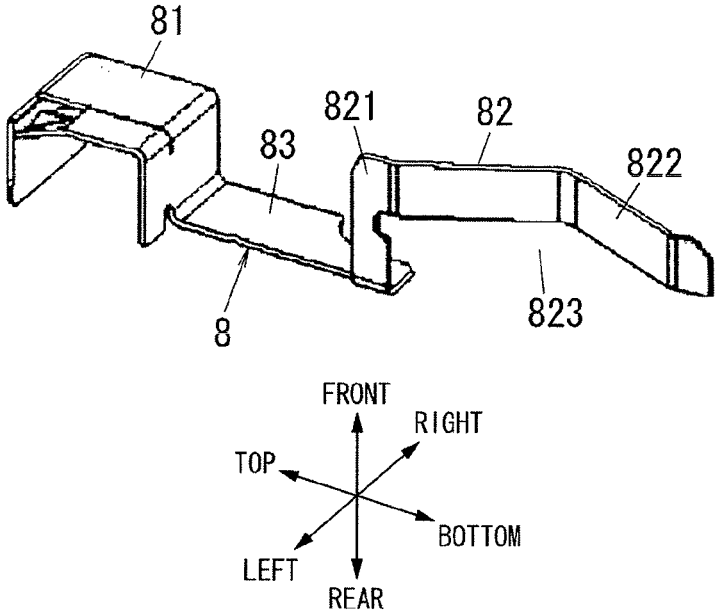
FIG. 11 is a perspective view illustrating the conductive plate of the lamp socket in accordance with the above embodiment.

Alternatively, as shown in FIGS. 8 to 10, the lamp socket "D" available for the LED lamp 300 can be formed by use of a socket body 7 used in the prior lamp socket available for a straight tube fluorescent lamp instead of the socket body 3, for example. As shown in FIG. 11, the lamp socket "D" includes a conductive plate 8 and the conductive plate 8 includes a fixed part 81, a pin connection part 82, and a coupling part 83. The fixed part 81 serves as a part to which a power supply cable (not shown) is connected. The pin connection part 82 serves as a part with which the pin 310 is in contact. The coupling part 83 connects the pin connection part 82 to the fixed part 81. In the following, this instance is explained based on upward, downward, left, and right directions in FIG. 11 and forward and rearward directions defined by directions normal to each of the upward, downward, left, and right directions.

The pin connection part 82 is constituted by a base piece 821 and a contact piece 822. The base piece 82 is protruded forward from an edge of one side in the left and right direction of the coupling part 83. The contact piece 822 extends downward from a lower end of the base piece 821. The contact piece 822 is formed into an approximate V-shape, and is inclined such that a center part is on the other side in the left and right direction relative to upper and lower ends. Additionally, a cutout 823 is formed in a rear side of the contact piece 822 from the upper end through the lower end.

The cutout 823 forms the space S2 in a similar manner as the lamp socket "B". Further, the space S3 formed between the space S2 and a peripheral wall of the socket body 7 constitutes the rotation space S4 together with the space S2. The rotation track of the extension piece 312 passes through the rotation space S4. Consequently, the LED lamp 300 can be attached to the lamp socket 7.

As explained above, the lamp socket "A" of the present embodiment has configurations similar to those of the lamp socket "A" of the first embodiment. Consequently, the lamp socket "A" of the present embodiment can produce an effect similar to that of the lamp socket "A" of the first embodiment.

Further, the conductive plate 2 is mounted on the bottom surface of the socket body 3. The conductive plate 2 is formed with the cutout at the side close to the bottom surface of the socket body 3 of the one end in the lengthwise direction of the conductive plate 2. According to this configuration, the second space S2 is formed.

Furthermore, the socket body 3 is provided at its inner surface with the first pedestal 420 and the limitation part. The first pedestal 420 has the first mounting surface 42*a* on which the one end (first end) in the lengthwise direction of the conductive plate 2 is mounted. The limitation part includes the first limitation piece 421 and the second limitation piece 53. The first limitation piece 421 faces the one surface (first surface) of the conductive plate 2. The second limitation piece 53 faces the other surface (second surface) of the conductive plate 2. The first limitation piece 421 and the second limitation piece 53 are arranged on the first pedestal 420. The conductive plate 2 is fixed on the bottom surface of the socket body 3 at the other end (second end) in the lengthwise direction.

Moreover, the conductive plate 2 includes the conductive plate body part and the protrusion piece 213. The conductive plate 2 is formed into a band plate shape and has the width direction along the axial direction of the light tube 320. The protrusion piece 213 extends perpendicularly from the conductive plate body part. The protrusion piece 213 is placed on the first mounting surface 42*a* so as to be in face-to-face contact with the first mounting surface 42*a*.

Besides, the protrusion piece 213 is mounted on the first mounting surface 42*a* in such a manner to be interposed between the first limitation piece 421 and the second limitation piece 53.

REFERENCE SIGNS LIST

A lamp socket
S1-S3 spaces (first to third spaces)
S4 rotation space
2 conductive plate
3 socket body

41*a* second mounting surface
42*a* first mounting surface
50*a* insertion hole
53 second limitation piece
53*a* inclined surface
213 protrusion piece
310 pin
311 contact piece
312 extension piece
320 light tube
330 base
411 pedestal (second pedestal)
420 pedestal (first pedestal)
421 first limitation piece

The invention claimed is:

1. A lamp socket for receiving a lamp including a light tube shaped into a straight tube and a base provided to an end of the light tube, wherein the base is provided with a pin including a contact piece extending along an axial direction of the light tube and an extension piece extending along a radial direction of the light tube from a tip of the contact piece, at its end surface in the axial direction, the lamp socket comprises:

a socket body formed into a hollow box shape and provided with an insertion hole at its primary surface; and a conductive plate for power supply, the conductive plate being formed into an approximate band plate shape, and the conductive plate being positioned inside the socket body so as to have a width direction along the axial direction and face the insertion hole, the conductive plate has one surface opposite to a central axis of the insertion hole, and a first space is provided between the other surface of the conductive plate and an inner periphery of the socket body, and a second space is provided between a bottom surface of the socket body opposite to the primary surface of the socket body and the conductive plate, and a third space is provided between the first space and the bottom surface of the socket body and communicates with the second space so as to form a rotation space together with the second space, when the pin of the lamp is inserted into the insertion hole and the lamp is rotated about its axis, the contact piece comes in contact with the one surface of the conductive plate and a rotation track of the extension piece passes through the rotation space, the socket body is provided at its inner surface with a first pedestal, a second pedestal, and a limitation part, the first pedestal having a first mounting surface on which one part of the conductive plate is mounted, the second pedestal being formed at a position far from the first pedestal and having a second mounting surface on which another part of the conductive plate is mounted, and the limitation part including a first limitation piece facing the one surface of the conductive plate and a second limitation piece facing the other surface of the conductive plate, and the conductive plate is fixed on the second mounting surface.

2. A lamp socket for receiving a lamp including a light tube shaped into a straight tube and a base provided to an end of the light tube, wherein the base is provided with a pin including a contact piece extending an axial direction of the light tube and an extension piece extending a radial direction of the light tube from a tip of the contact piece, at its end surface in the axial direction, the lamp socket comprises:

a socket body formed into a hollow box shape and provided with an insertion hole at its primary surface; and a conductive plate for power supply, the conductive plate being formed into an approximate band plate shape, and the conductive plate being positioned inside the socket body so as to have a width direction along the axial direction and face the insertion hole, the conductive plate has one surface opposite to a central axis of the insertion hole, and a first space is provided between the other surface of the conductive plate and an inner periphery of the socket body, and a second space is provided between a bottom surface of the socket body opposite to the primary surface of the socket body and the conductive plate, and a third space is provided between the first space and the bottom surface of the socket body and communicates with the second space so as to form a rotation space together with the second space, when the pin of the lamp is inserted into the insertion hole and the lamp is rotated about its axis, the contact piece comes in contact with the one surface of the conductive plate and a rotation track of the extension piece passes through the rotation space, the conductive plate is mounted on the bottom surface of the socket body, the conductive plate is formed with a cutout at a side close to the bottom surface of the socket body of one end in a lengthwise direction of the conductive plate so as to form the second space, the socket body is provided at its inner surface with a first pedestal, and a limitation part, the first pedestal having a first mounting surface on which the one end in the lengthwise direction of the conductive plate is mounted, and the limitation part being arranged on the first mounting surface and including a first limitation piece facing the one surface of the conductive plate and a second limitation piece facing the other surface of the conductive plate, and the conductive plate is fixed on the bottom surface of the socket body at the other end in the lengthwise direction.

3. The lamp socket as set forth in claim 1, wherein the conductive plate comprises:

a conductive plate body part formed into a band plate shape and having the width direction along the axial direction; and a protrusion piece extending perpendicularly from the conductive plate body part, the protrusion piece being placed on the first mounting surface so as to be in face-to-face contact with the first mounting surface.

4. The lamp socket as set forth in claim 1, wherein:

the socket body is constituted by a first member provided with the first pedestal and a second member provided with the insertion hole; and one limitation piece of the first limitation piece and the second limitation piece is formed on the first mounting surface of the first pedestal; and the other limitation piece of the first limitation piece and the second limitation piece is formed on a surface of the second member facing the first mounting surface; and the other limitation piece has an inclined surface which is inclined to be farther away from the one limitation piece as being closer to the first mounting surface.

5. The lamp socket as set forth in claim 2, wherein the conductive plate comprises:

a conductive plate body part formed into a band plate shape and having the width direction along the axial direction; and a protrusion piece extending perpendicularly from the conductive plate body part, the protrusion piece being placed on the first mounting surface so as to be in face-to-face contact with the first mounting surface.

6. The lamp socket as set forth in claim 2, wherein:

the socket body is constituted by a first member provided with the first pedestal and a second member provided with the insertion hole; and one limitation piece of the first limitation piece and the second limitation piece is formed on the first mounting surface of the first pedestal; and the other limitation piece of the first limitation piece and the second limitation piece is formed on a surface of the second member facing the first mounting surface; and the other limitation piece has an inclined surface which is inclined to be farther away from the one limitation piece as being closer to the first mounting surface.

7. The lamp socket as set forth in claim 3, wherein:

the socket body is constituted by a first member provided with the first pedestal and a second member provided with the insertion hole; and one limitation piece of the first limitation piece and the second limitation piece is formed on the first mounting surface of the first pedestal; and the other limitation piece of the first limitation piece and the second limitation piece is formed on a surface of the second member facing the first mounting surface; and the other limitation piece has an inclined surface which is inclined to be farther away from the one limitation piece as being closer to the first mounting surface.

* * * * *